US012055305B2

(12) United States Patent
Yoon et al.

(10) Patent No.: US 12,055,305 B2
(45) Date of Patent: Aug. 6, 2024

(54) DIFFUSER, DIFFUSER ASSEMBLY, AND AIR CONDITIONER HAVING THE SAME

(71) Applicant: Samsung Electronics Co., Ltd., Suwon-si (KR)

(72) Inventors: Seonghyun Yoon, Suwon-si (KR); Jinbaek Kim, Suwon-si (KR); Mingi Cho, Suwon-si (KR); Kyunghoon Kim, Suwon-si (KR); Eunyoung Bae, Suwon-si (KR); Eungryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 744 days.

(21) Appl. No.: 17/080,232

(22) Filed: Oct. 26, 2020

(65) Prior Publication Data

US 2021/0123611 A1 Apr. 29, 2021

(30) Foreign Application Priority Data

Oct. 28, 2019 (KR) ..... 10-2019-0134846

(51) Int. Cl.
*F24F 1/0033* (2019.01)
*F04D 17/06* (2006.01)
(Continued)

(52) U.S. Cl.
CPC ..... *F24F 1/0033* (2013.01); *F04D 17/06* (2013.01); *F04D 25/166* (2013.01);
(Continued)

(58) Field of Classification Search
CPC ..... F02D 17/06; F02D 19/002; F02D 25/166; F02D 29/4253; F02D 29/444;
(Continued)

(56) References Cited

U.S. PATENT DOCUMENTS 2,100,994 A * 11/1937 Cohen ..... F04D 29/703 415/121.2
5,489,186 A * 2/1996 Yapp ..... F01D 5/141 415/58.7
(Continued)

FOREIGN PATENT DOCUMENTS

CN 106030120 A 10/2016
CN 209042570 U 6/2019
(Continued)

OTHER PUBLICATIONS

International Search Report and Written Opinion of the International Searching Authority dated Feb. 3, 2021 for International Application No. PCT/KR2020/014635, 10 pages.
(Continued)

*Primary Examiner* — John M Zaleskas
(74) *Attorney, Agent, or Firm* — STAAS & HALSEY LLP

(57) ABSTRACT

A diffuser, which is used in an air conditioner, includes a central portion where a motor is disposed, and a plurality of blades radially disposed on an outer circumferential surface of the central portion and arranged at regular intervals along the outer circumferential surface of the central portion. An outer guide wall is disposed concentrically with the central portion and is formed to surround the plurality of blades. The outer guide wall includes a plurality of openings formed in a plurality of portions each of which corresponds to a space between two adjacent blades among the plurality of blades.

21 Claims, 20 Drawing Sheets

(51) Int. Cl.

| | |
|---|---|
| ***F04D 25/16*** | (2006.01) |
| ***F04D 29/42*** | (2006.01) |
| ***F04D 29/44*** | (2006.01) |
| ***F04D 29/70*** | (2006.01) |
| ***F24F 1/0007*** | (2019.01) |
| ***F24F 1/0011*** | (2019.01) |
| ***F24F 1/0018*** | (2019.01) |
| ***F24F 8/10*** | (2021.01) |
| ***F24F 13/06*** | (2006.01) |

(52) U.S. Cl.
CPC ..... *F04D 29/4253* (2013.01); *F04D 29/444* (2013.01); *F04D 29/703* (2013.01); *F24F 1/0007* (2013.01); *F24F 1/0011* (2013.01); *F24F 1/0018* (2013.01); *F24F 8/10* (2021.01); *F24F 13/06* (2013.01)

(58) Field of Classification Search
CPC .... F02D 29/542; F02D 29/544; F02D 29/703; F24F 1/0007; F24F 1/0011; F24F 1/0018; F24F 1/0033; F24F 1/028; F24F 1/0287; F24F 1/38; F24F 8/10; F24F 13/06; F24F 13/062; F24F 13/08
See application file for complete search history.

(56) References Cited

U.S. PATENT DOCUMENTS

| | | | | |
|---|---|---|---|---|
| 6,398,492 | B1 * | 6/2002 | Cho | F04D 29/544 416/189 |
| 6,406,258 | B1 | 6/2002 | Lin et al. | |
| 6,863,496 | B2 | 3/2005 | Cho et al. | |
| D732,655 | S * | 6/2015 | Ueno | D23/370 |
| 9,822,801 | B2 | 11/2017 | Nakagawa et al. | |
| 10,393,150 | B2 | 8/2019 | Nakagawa et al. | |
| 11,708,990 | B2 | 7/2023 | Chu et al. | |
| RE49,709 | E | 10/2023 | Nakagawa et al. | |
| 2005/0025620 | A1 * | 2/2005 | Horng | F04D 29/667 415/211.2 |
| 2006/0147304 | A1 * | 7/2006 | Cho | F04D 29/544 415/191 |
| 2007/0098544 | A1 * | 5/2007 | Wang | F04D 29/544 415/126 |
| 2007/0196208 | A1 * | 8/2007 | Takemoto | F04D 29/5806 415/220 |
| 2008/0308261 | A1 * | 12/2008 | Aschermann | F04D 29/544 415/223 |
| 2009/0110551 | A1 * | 4/2009 | Yoshida | F04D 25/0613 415/220 |
| 2014/0053591 | A1 * | 2/2014 | Shin | F24F 13/20 62/285 |
| 2014/0096941 | A1 | 4/2014 | Yun et al. | |
| 2014/0360212 | A1 * | 12/2014 | Bae | F24F 11/83 62/89 |
| 2015/0330411 | A1 * | 11/2015 | Heli | F04D 29/563 415/208.2 |
| 2016/0032942 | A1 * | 2/2016 | Jung | F04D 19/002 415/148 |
| 2016/0208674 | A1 * | 7/2016 | Kim | F04D 29/526 |
| 2016/0281739 | A1 * | 9/2016 | Nakagawa | F04D 29/667 |
| 2016/0305448 | A1 * | 10/2016 | Hong | F01P 5/06 |
| 2016/0305452 | A1 * | 10/2016 | Nakagawa | F25B 39/00 |
| 2017/0016633 | A1 | 1/2017 | Jeon et al. | |
| 2017/0023264 | A1 | 1/2017 | Ha et al. | |
| 2017/0159947 | A1 | 6/2017 | Jeon et al. | |
| 2018/0001248 | A1 | 1/2018 | Jung et al. | |
| 2018/0209667 | A1 | 7/2018 | Jeon et al. | |
| 2018/0245602 | A1 * | 8/2018 | Stevens | F04D 25/08 |
| 2018/0320909 | A1 * | 11/2018 | Ha | F24F 11/76 |
| 2019/0024909 | A1 * | 1/2019 | Lee | F24F 1/0007 |
| 2020/0063991 | A1 * | 2/2020 | Bae | F24F 13/065 |
| 2020/0096207 | A1 * | 3/2020 | Kim | F24F 1/0073 |
| 2020/0208653 | A1 * | 7/2020 | Tokuno | H02K 7/14 |
| 2020/0282797 | A1 * | 9/2020 | Kim | B60H 1/00657 |
| 2020/0284449 | A1 * | 9/2020 | Kim | F24F 13/08 |
| 2020/0386423 | A1 | 12/2020 | Chu et al. | |
| 2021/0088055 | A1 * | 3/2021 | Hong | F04D 29/547 |

FOREIGN PATENT DOCUMENTS

| | | |
|---|---|---|
| JP | 3077756 | 3/2001 |
| JP | 2007-224779 | 9/2007 |
| JP | 2016-17458 | 2/2016 |
| KR | 10-0548036 | 1/2006 |
| KR | 10-0729650 | 6/2007 |
| KR | 10-0912526 | 8/2009 |
| KR | 10-2010-0041127 | 4/2010 |
| KR | 20100041127 A * | 4/2010 |
| KR | 10-0974355 | 7/2010 |
| KR | 20-2013-0000233 | 1/2013 |
| KR | 10-1263650 | 5/2013 |
| KR | 10-2014-0019207 | 2/2014 |
| KR | 10-2016-0017587 | 2/2016 |
| KR | 10-2017-0009808 | 1/2017 |
| KR | 10-1866841 | 6/2018 |
| KR | 10-1916887 | 11/2018 |
| KR | 10-2019-0010395 A | 1/2019 |
| KR | 10-1976793 | 5/2019 |
| KR | 10-1985537 | 5/2019 |
| KR | 10-2019-0072368 A | 6/2019 |
| WO | 2019/017610 | 1/2019 |

OTHER PUBLICATIONS

Extended European Search Report dated Aug. 9, 2022 for European Application No. 20882680.0.
Chinese Office Action issued in counterpart Chinese Application 202080075002.0 dated Nov. 28, 2023.
Korean Office Action dated Apr. 22, 2024 for Korean Application No. 10-2019-0134846.

* cited by examiner

PRIOR ART

PRIOR ART

| CLASSIFICATION | | PRIOR ART | EMBODIMENT 1 | EMBODIMENT 2 |
|---|---|---|---|---|
| AIR VOLUME [CMM] (1250/ 1170RPM) | LEFT | 3.92 | 4.07 | 4.08 |
| | TOP | 1.97 | 2.06 | 2.14 |
| | RIGHT | 3.56 | 3.82 | 3.77 |
| | WINDLESS PANEL | 1.46 | 1.44 | 1.43 |
| | TOTAL | 10.91 | 11.39(4.40%↑) | 11.42(4.67%↑) |
| THREE-SIDED FLOW RATE DEVIATION[m/s] | | 1.17 | 0.95 | 0.99 |
| FLOW RATE DISTRIBUTION IN DISCHARGE PORT (LEFT/TOP/RIGHT) | |   |   |   |

DIFFUSER, DIFFUSER ASSEMBLY, AND AIR CONDITIONER HAVING THE SAME

CROSS-REFERENCE TO RELATED APPLICATIONS

This application is based on and claims priority under 35 U.S.C. § 119 to Korean Patent Application No. 10-2019-0134846, filed on Oct. 28, 2019, in the Korean Intellectual Property Office, the disclosure of which is incorporated by reference herein in its entirety.

BACKGROUND

1. Field

The disclosure relates to a diffuser used in an air conditioner.

2. Description of the Related Art

Generally, a fan flow path structure applied to an air conditioner is designed so that the direction of an air flow discharged from a fan and the direction of an air outlet of the air conditioner coincide with each other in order to minimize pressure loss.

However, recently, for design or functional purposes, air conditioners in which the direction of the air flow discharged from the fan and the direction of the air outlet of the air conditioner do not match each other are commercially available.

In extreme cases, there are air conditioners in which the direction of air flow discharged from the fan is bent at a right angle to the direction the air outlet. An air conditioner having such a structure reduces the flow performance compared to an air conditioner in which the direction of air flow and the direction of the air outlet coincide under the condition that the same fan is used at the same rotational speed, and accordingly, power consumption and noise may increase.

In order to improve the flow performance of air conditioners in which the direction of air flow discharged from the fan and the direction of the air outlet are different, a mixed flow fan having a larger discharge angle than that of a general axial fan is used.

However, even in the case of an air conditioner using the mixed flow fan, there is a problem in that the flow performance is poor compared to the air conditioner in which the direction of air flow discharged from the fan coincides with the direction of the air outlet.

Therefore, it is necessary to further improve the flow performance of the air conditioner in which the direction of the air flow discharged from the fan and the direction of the air outlet are different.

SUMMARY

The disclosure has been developed in order to overcome the above drawbacks and other problems associated with the conventional arrangement. An aspect of the disclosure relates to a diffuser and a diffuser assembly which can improve a flow performance of an air conditioner, and an air conditioner having the same.

According to an aspect of the disclosure, a diffuser that is used in an air conditioner, may include a central portion where a motor is disposed; a plurality of blades radially disposed on an outer circumferential surface of the central portion and arranged at regular intervals along the outer circumferential surface of the central portion; and an outer guide wall disposed concentrically with the central portion and formed to surround the plurality of blades, wherein the outer guide wall comprises a plurality of openings formed in a plurality of portions each of which corresponds to a space between two adjacent blades among the plurality of blades.

Each of the plurality of openings may be formed such that a portion of each of the plurality of openings facing a first end of the outer guide wall corresponding to upstream based on a direction of air flow passing through the diffuser is closed, and another portion of each of the plurality of openings facing a second end of the outer guide wall corresponding to downstream is open.

According to another aspect of the disclosure, a diffuser assembly that is used in an air conditioner, the diffuser assembly may include a motor; a fan coupled to a shaft of the motor and configured to discharge air; and a diffuser in which the motor is disposed, the diffuser configured to guide the air discharged by the fan, wherein the diffuser may include a central portion where the motor is disposed; a plurality of blades radially disposed on an outer circumferential surface of the central portion and arranged at regular intervals along the outer circumferential surface of the central portion; and an outer guide wall disposed concentrically with the central portion and formed to surround the plurality of blades, wherein the outer guide wall comprises a plurality of openings formed in a plurality of portions each of which corresponds to a space between two adjacent blades among the plurality of blades.

According to another aspect of the disclosure, an air conditioner may include a main body provided with a front opening in a front surface thereof; a diffuser disposed in the front opening of the main body; a motor disposed in the diffuser; a fan disposed in the front opening and configured to rotate by the motor; a front panel spaced apart from the front surface of the main body and disposed to cover the diffuser; and an air outlet formed between an edge of the front panel and an edge of the front opening of the main body, wherein the diffuser may include a central portion where the motor is disposed; a plurality of blades radially disposed on an outer circumferential surface of the central portion and arranged at regular intervals along the outer circumferential surface of the central portion; and an outer guide wall disposed concentrically with the central portion and formed to surround the plurality of blades, wherein the outer guide wall comprises a plurality of openings formed in a plurality of portions each of which corresponds to a space between two adjacent blades among the plurality of blades.

The front panel may be disposed to be movable by a predetermined distance in a vertical direction with respect to the front surface of the main body, and when the front panel is away from the diffuser, the air outlet may be open, and when the front panel approaches the diffuser closest, the air outlet may be closed.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION OF THE EMBODIMENTS

Hereinafter, certain embodiments of the disclosure will be described in detail with reference to the accompanying drawings.

Hereinafter, embodiments of a diffuser, a diffuser assembly, and an air conditioner having the same according to the present disclosure will be described in detail with reference to the accompanying drawings.

Various embodiments of the disclosure will hereinafter be described with reference to the accompanying drawings. However, it is to be understood that technologies mentioned in the disclosure are not limited to specific embodiments, but include various modifications, equivalents, and/or alternatives according to embodiments of the disclosure. The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the present disclosure, a first component may be referred to as a second component, and similarly, a second component may also be referred to as a first component.

The terms used in embodiments of the present disclosure may be construed as commonly known to those skilled in the art unless otherwise defined.

Further, the terms 'leading end', 'rear end', 'upper side', 'lower side', 'top end', 'bottom end', etc. used in the present disclosure are defined with reference to the drawings. However, the shape and position of each component are not limited by the terms.

Hereinafter, an air purifier will be described as an example of an air conditioner.

Figure 1:
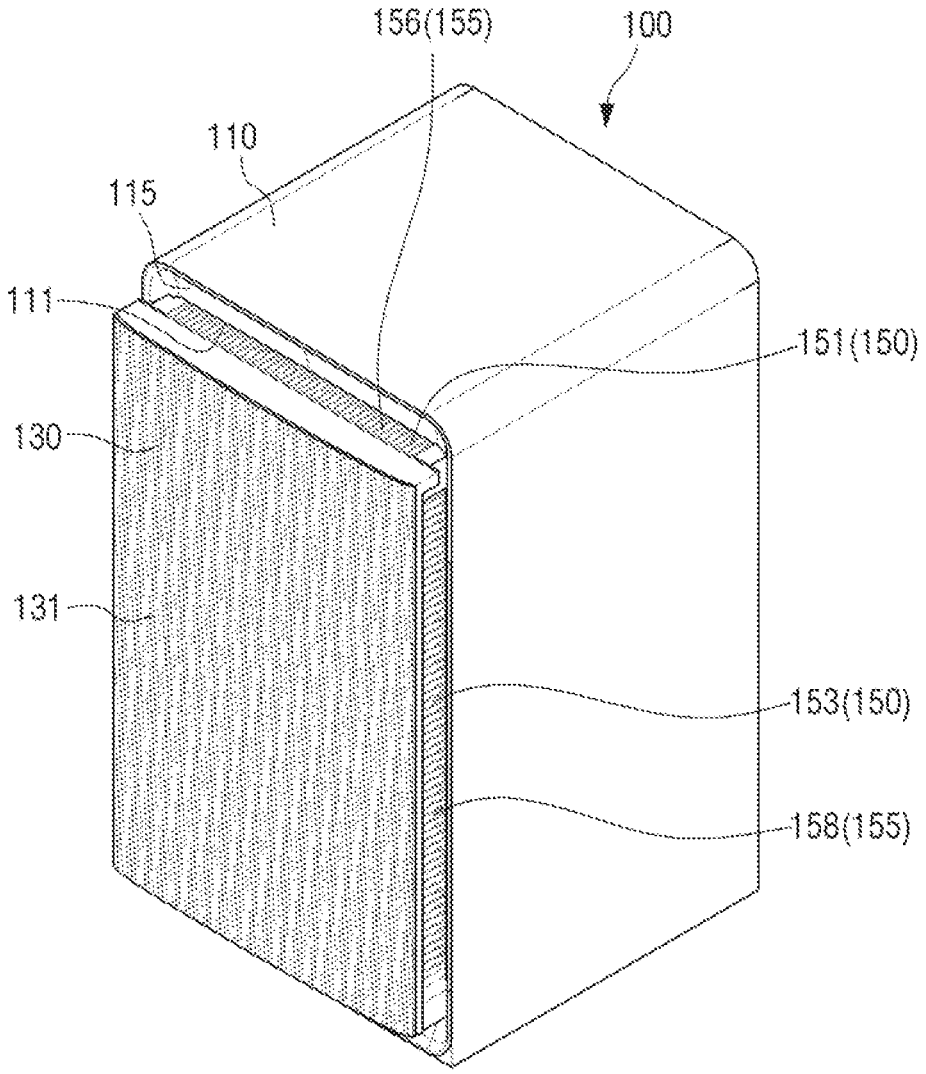
FIG. 1 is a perspective view illustrating an air conditioner according to an embodiment.
Figure 2:
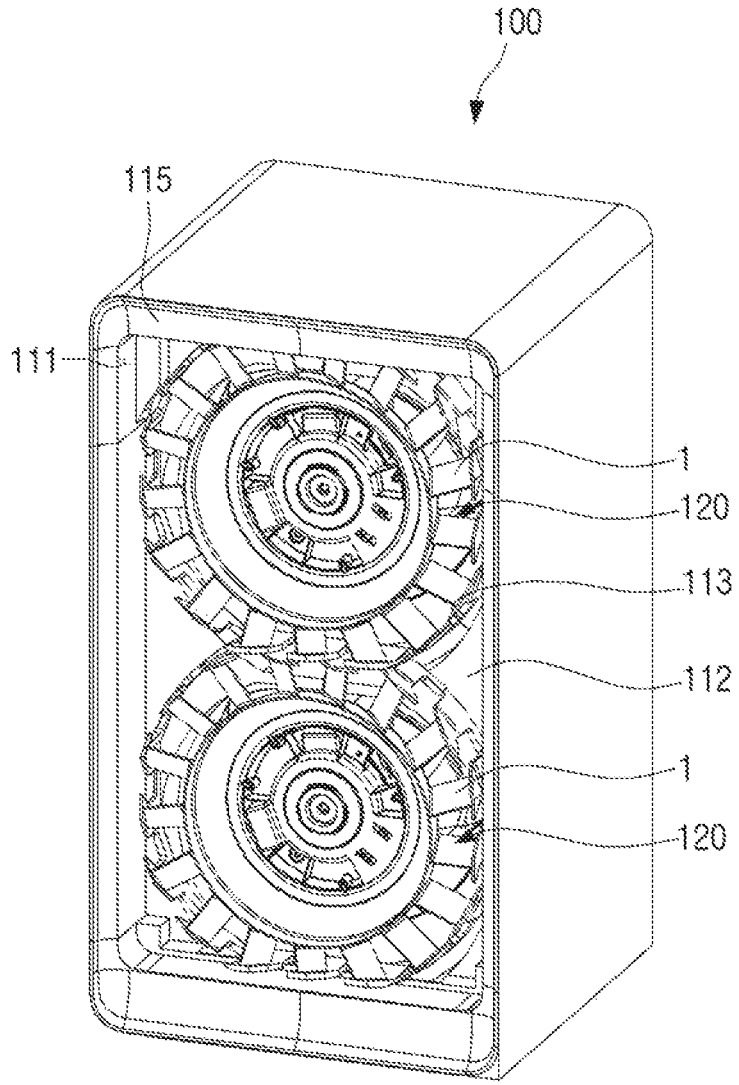
FIG. 2 is a perspective view illustrating a state in which a front panel is removed from the air conditioner of FIG. 1.
Figure 3:
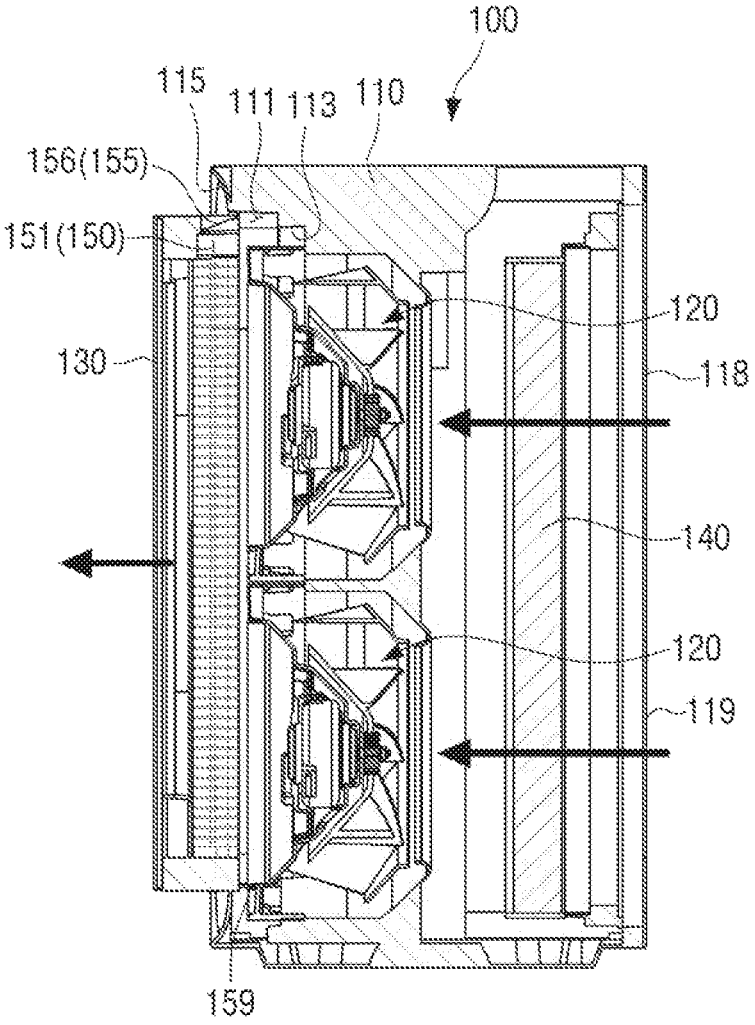
FIG. 3 is a cross-sectional view illustrating the air conditioner of FIG. 1.
Figure 4:
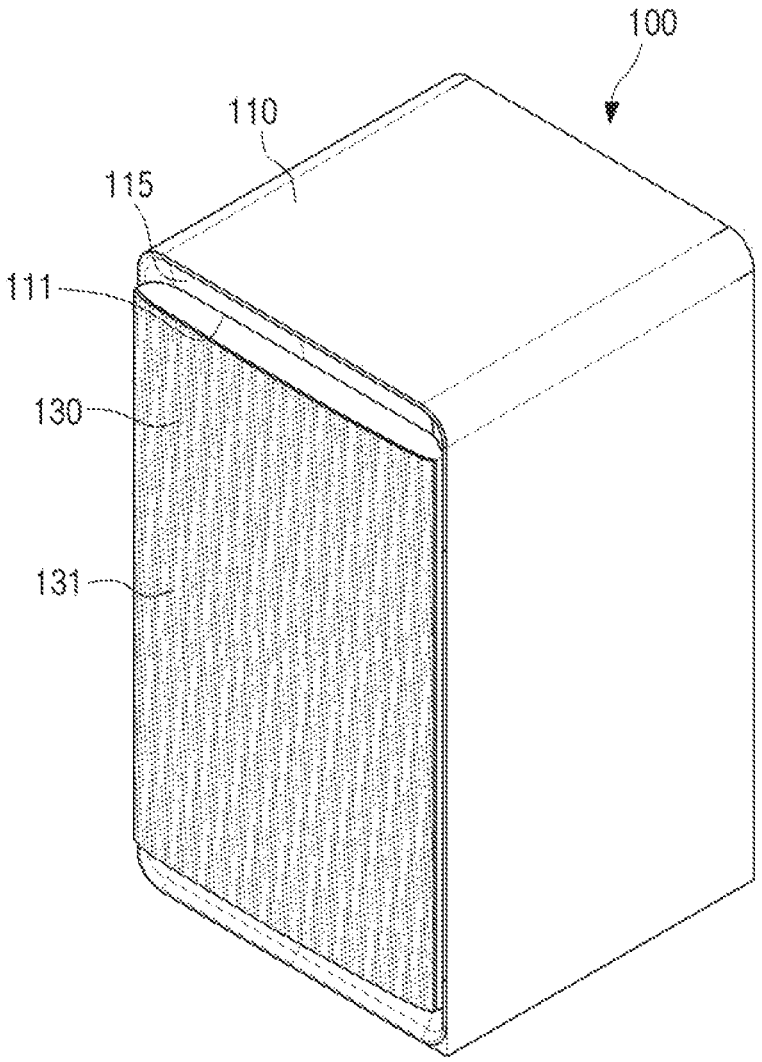
FIG. 4 is a perspective view illustrating an air conditioner according to an embodiment when a front panel is closed.
Figure 5:
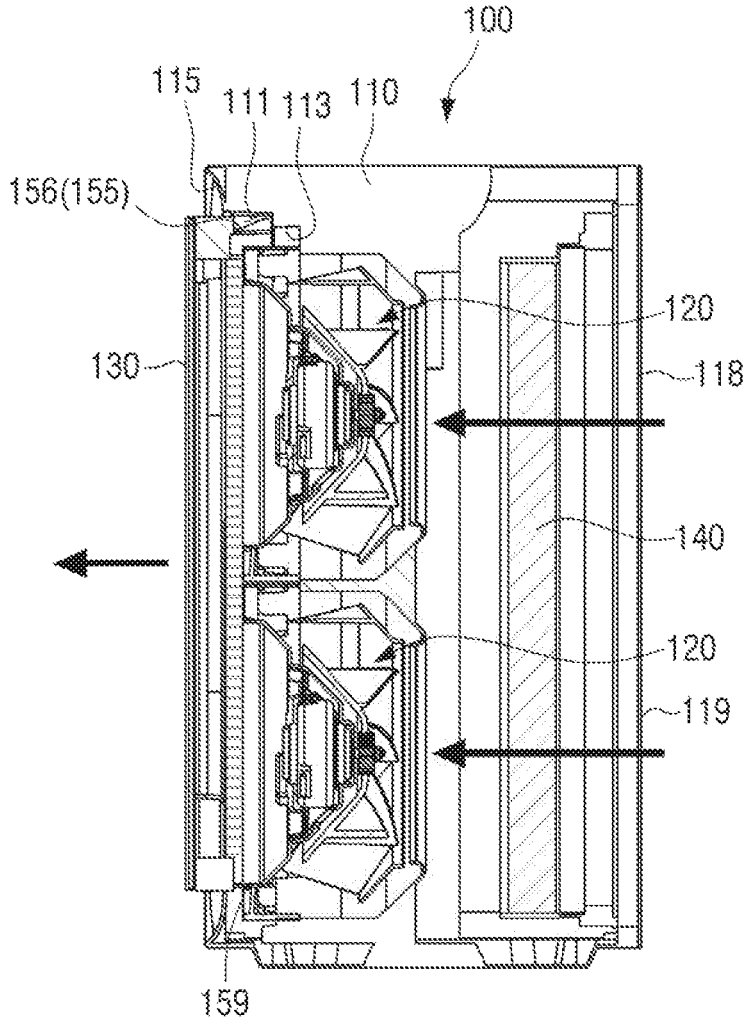
FIG. 5 is a cross-sectional view illustrating the air conditioner of FIG. 4.

FIG. 1 is a perspective view illustrating an air conditioner according to an embodiment. FIG. 2 is a perspective view illustrating a state in which a front panel is removed from the air conditioner of FIG. 1. FIG. 3 is a cross-sectional view illustrating the air conditioner of FIG. 1. FIG. 4 is a perspective view illustrating an air conditioner according to an embodiment when a front panel is closed. FIG. 5 is a cross-sectional view illustrating the air conditioner of FIG. 4.

Referring to FIGS. 1 to 3, an air conditioner 100 according to an embodiment of the disclosure may include a main body 110, a diffuser assembly 120, and a front panel 130.

The main body 110 may be formed in a substantially rectangular parallelepiped shape, and a front opening 111 is provided in the front surface of the main body 110. The front opening 111 of the main body 110 may be formed in a rectangular shape corresponding to the front surface of the main body 110 and may include a bottom surface 112.

A diffuser hole 113 in which the diffuser assembly 120 is disposed is formed in the bottom surface 112 of the front opening 111. In the case of the air conditioner 100 according to an embodiment, because two diffuser assemblies 120 are used, two diffuser holes 113 are provided in the bottom surface 112 of the front opening 111. The two diffuser holes 113 may be formed vertically on the bottom surface 112 of the front opening 111 as shown in FIG. 2.

A guide surface 115 may be provided around the front opening 111 of the main body 110. The guide surface 115 may be formed as a concave curved surface connecting the edge of the front surface of the main body 110 and the edge of the front opening 111. The guide surface 115 may be formed to guide air discharged through the front opening 111 to the front of the main body 110.

Components capable of implementing a function of the air conditioner 100 are disposed inside the main body 110. For example, when the air conditioner 100 according to an embodiment is implemented as an air purifier, a fitter 140 may be disposed inside the main body 110.

The filter 140 may be formed by stacking several types of filters. The several types of fitters may include a high efficiency particulate air (HEPA) fitter, a charcoal deodorization fitter, and the like. A plurality of intake ports 119 through which external air is introduced may be provided in the rear surface 118 of the main body 110. The external air introduced through the plurality of intake ports 119 may pass through the filter 140.

The diffuser assembly 120 may be formed to generate a suction force for sucking external air. The diffuser assembly 120 may be disposed in the front opening 111 of the main body 110. The fitter 140 may be disposed behind the diffuser assembly 120.

In other words, the diffuser assembly 120 may be disposed in the front opening 111 in front of the filter 140 provided in the main body 110. In detail, the diffuser assembly 120 may be fixed to the diffuser hole 113 formed in the bottom surface 112 of the front opening 111 of the main body 110.

Accordingly, when the diffuser assembly 120 operates, a suction force is generated so that external air is introduced through the intake ports 119 of the rear surface 118 of the main body 110 and passes through the filter 140. The air that has passed through the fitter 140 passes through the diffuser assembly 120, and then, is discharged through the front opening 111 of the main body 110. The structure of the diffuser assembly 120 will be described in detail below.

The front panel 130 may be formed in a rectangular shape corresponding to the front opening 111 of the main body 110 and is disposed on the front surface of the main body 110. The front panel 130 may be spaced by a predetermined distance apart from the front surface of the main body 110, that is, the guide surface 115 of the main body 110, and may be disposed to cover the diffuser assembly 120.

An air outlet 150 may be provided between the front panel 130 and the front opening 111 of the main body 110. In other words, a gap between the front surface of the main body 110 and the front panel 130 that is spaced by a predetermined distance apart from the front surface of the main body 110 may form the air outlet 150. In detail, a space between the edge of the front panel 130 and the edge of the front opening 111 of the main body 110 may form the air outlet 150.

The air outlet 150 may include an upper air outlet 151 formed on the upper side of the front panel 130, a left air outlet formed on the left side of the front panel 130, and a right air outlet 153 formed on the right side of the front panel 130.

A grill 155 may be disposed in the air outlet 150. For example, an upper grill 156 may be disposed at the upper air outlet 151, a left grill may be disposed at the left air outlet, and a right grill 158 may be disposed at the right air outlet 153.

The grill 155 may protrude from the border of the rear surface of the front panel 130 toward the front opening 111 of the main body 110 and may be formed to be inserted into the front opening 111.

For example, the upper grill 156 may be formed to protrude from the upper end of the front panel 130 toward the upper side of the front opening 111 of the main body 110. The left grill may be formed to protrude from the left end of the front panel 130 toward the left side of the front opening 111 of the main body 110. The right grill 158 may be formed to protrude from the right end of the front panel 130 toward the right side of the front opening 111 of the main body 110.

The upper grill 156, the left grill, and the right grill 158 may be formed to have the same height. Further, the grill 155, that is, the upper grill 156, the left grill, and the right grill 158 may be formed as a plurality of slits formed at predetermined intervals. Accordingly, air discharged from the diffuser assembly 120 may be discharged to the outside through the plurality of slits of the grill 155.

An air blocking portion 159 may be provided at the lower end of the front panel 130 to block air discharged from the diffuser assembly 120 from being discharged through the lower portion of the front panel 130.

The air blocking portion 159 may be formed to protrude from the lower end of the front panel 130 toward the lower side of the front opening 111 of the main body 110. The air blocking portion 159 may be formed to be inserted into the front opening 111 of the main body 110 together with the grill 155.

The front panel 130 may be formed as a windless panel. For example, a myriad of micro-holes 131 may be formed in the front panel 130 over almost the entire front surface of the front panel 130.

Accordingly, air from the diffuser assembly 120 may be discharged to the outside through the micro-holes 131 of the front panel 130. In this case, because the air discharged from the diffuser assembly 120 collides with the rear surface of the front panel 130 and is discharged to the outside through the micro-holes 131, the intensity of the air flow may be weakened. Accordingly, the air flow discharged through the windless panel, that is, the front panel 130 may be weaker than the air flow discharged through the air outlet 150.

In addition, the front panel 130 may be disposed to be movable by a predetermined distance in the vertical direction with respect to the front surface of the main body 110. For example, the front panel 130 may be formed to be positioned at any one of a first position in which the front panel 130 is spaced apart from the front opening 111 of the main body 110 by a predetermined distance and a second position in which the front panel 130 is inserted into the front opening 111 of the main body 110.

As illustrated in FIGS. 1 and 3, when the front panel 130 is positioned in the first position, the front panel 130 is moved away from the diffuser assembly 120 and the air outlet 150 is formed between the front panel 130 and the front opening 111 of the main body 110.

Accordingly, when the front panel 130 is in the first position, air discharged from the diffuser assembly 120 is discharged through the air outlet 150. In this case, some of air discharged from the diffuser assembly 120 may be discharged through the plurality of micro-holes 131 of the front panel 130.

When the front panel 130 is in the first position, the grill 155 provided in the air outlet 150 is exposed to the outside as illustrated in FIG. 1. Accordingly, air discharged from the diffuser assembly 120 is discharged to the outside through the grill 155.

As illustrated in FIGS. 4 and 5, when the front panel 130 is positioned in the second position, the front panel 130 approaches the diffuser assembly 120 closest, and the air outlet 150 between the front panel 130 and the front opening 111 of the main body 110 is closed.

In detail, when the front panel 130 is closed, the leading end of the grill 155 of the front panel 130 may be in contact with or adjacent to the bottom surface 112 of the front opening 111 of the main body 110, and a portion of the side surface of the front panel 130 may be inserted into the front opening 111.

Accordingly, when the front panel 130 is in the second position, because the air outlet 150 is closed, the air discharged from the diffuser assembly 120 may not be discharged through the air outlet 150, but may be discharged through the plurality of micro-holes 131 of the front panel 130.

Hereinafter, the diffuser assembly 120 according to an embodiment of the disclosure will be described in detail with reference to FIGS. 6, 7, and 8.

Figure 6:
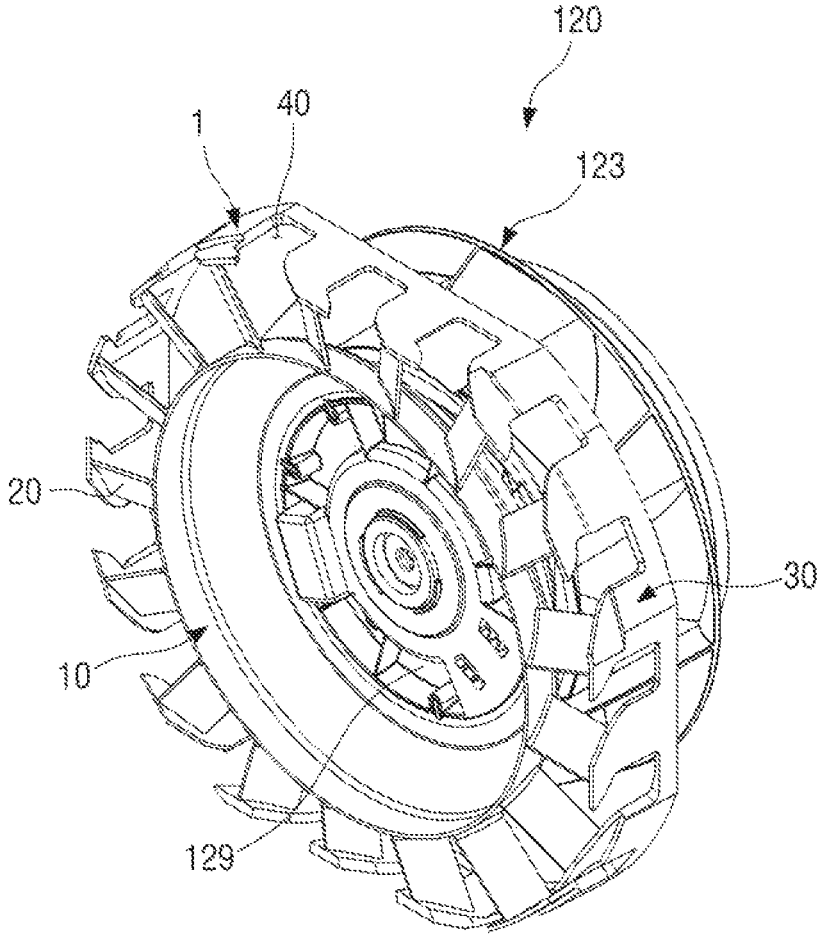
FIG. 6 is a perspective view illustrating a diffuser assembly according to an embodiment.

FIG. 6 is a perspective view illustrating a diffuser assembly according to an embodiment. FIG. 7 is an exploded perspective view of the diffuser assembly of FIG. 6. FIG. 8 is a cross-sectional view of the diffuser assembly of FIG. 6.

Figure 7:
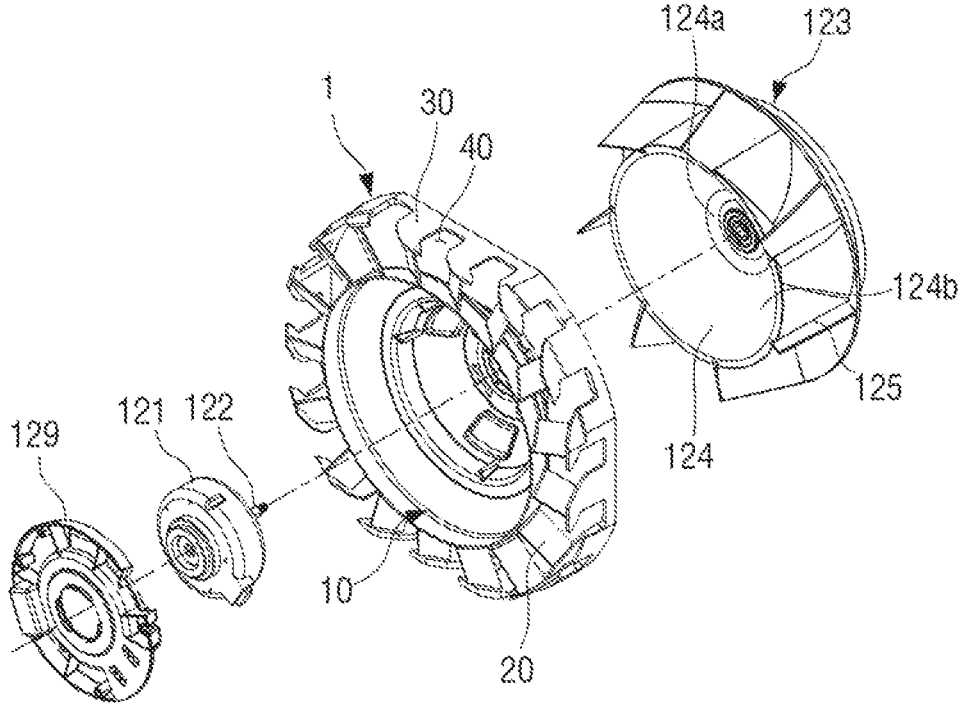
FIG. 7 is an exploded perspective view of the diffuser assembly of FIG. 6.
Figure 8:
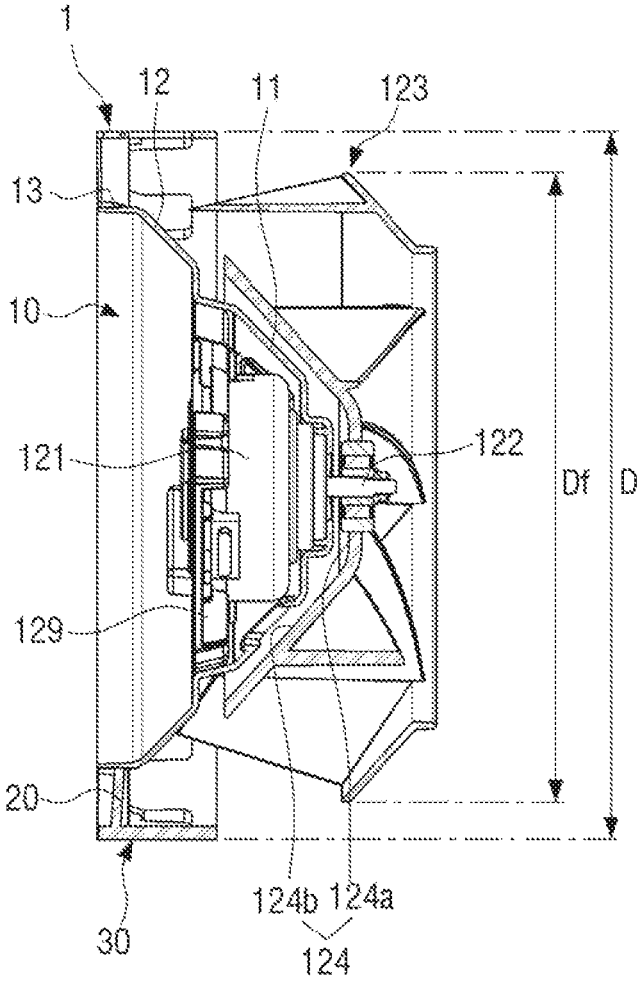
FIG. 8 is a cross-sectional view of the diffuser assembly of FIG. 6

Referring to FIGS. 6, 7, and 8, the diffuser assembly 120 according to an embodiment of the disclosure may include a motor 121, a fan 123, and a diffuser 1.

The motor 121 generates a rotational force that rotates the fan 123, and various types of motors may be used as the motor 121 as long as they can rotate the fan 123 in one direction.

The fan 123 may be formed to be rotated by the motor 121 to generate a suction force. The fan 123 may be coupled to a shaft 122 of the motor 121. When the motor 121 rotates, the fan 123 sucks air and discharges it toward the motor 121. The fan 123 may be implemented as a mixed flow fan configured to discharge air in a direction inclined at an angle with respect to the shaft 122 of the motor 121.

The fan 123 may include a hub 124 to which one end of the motor shaft 122 is coupled and a plurality of blades 125 disposed at predetermined intervals on the outer circumferential surface of the hub 124.

The hub 124 may be formed in a bowl shape. For example, the hub 124 may include a center plate 124*a* to which the shaft 122 of the motor 121 is coupled and an inclined portion 124*b* extending obliquely outward from the outer circumferential surface of the center plate 124*a*. The plurality of blades 125 are disposed on the outer circumferential surface of the inclined portion 124*b*.

Therefore, when the motor 121 rotates, the fan 123 rotates. When the fan 123 rotates, the air on the right side of the fan 123 in FIG. 8 is sucked into the fan 123, and then discharged in a direction inclined with respect to the shaft 122 of the motor 121.

The diffuser 1 may be disposed downstream in the direction in which air is discharged from the fan 123.

The diffuser 1 may fix the motor 121, and may be formed to guide the air discharged from the above-described fan 123 to the rear of the fan 123. When the diffuser 1 is fixed to the diffuser hole 113 of the front opening 111 of the main body 110, the diffuser assembly 120 is fixed to the main body 110.

Hereinafter, the diffuser 1 according to an embodiment of the disclosure will be described in detail with reference to FIGS. 9, 10, and 11.

Figure 9:
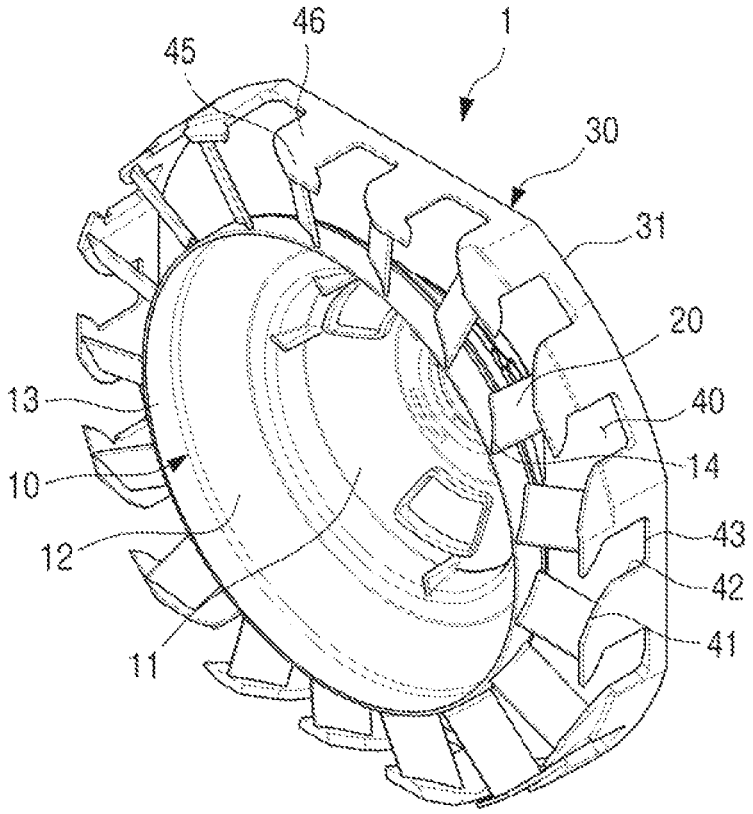
FIG. 9 is a perspective view illustrating a diffuser according to an embodiment.

FIG. 9 is a perspective view illustrating a diffuser according to an embodiment. FIG. 10 is a front view of the diffuser of FIG. 9. FIG. 11 is a side view of the diffuser of FIG. 9.

Figure 10:
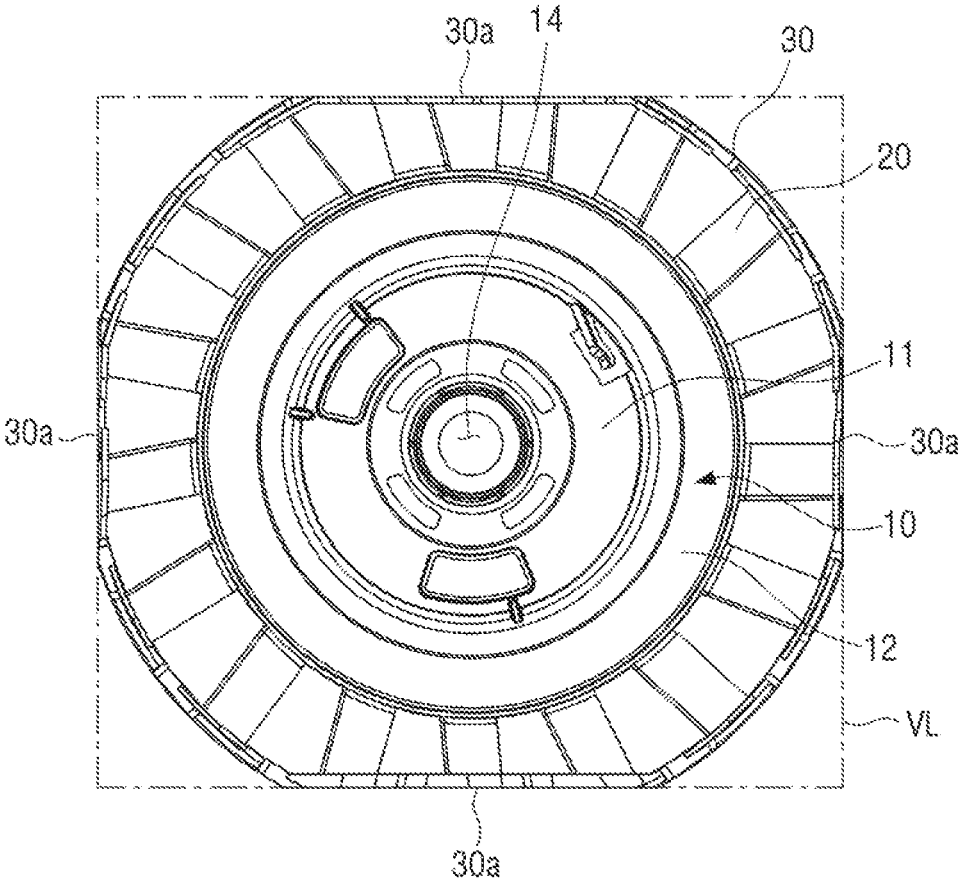
FIG. 10 is a front view of the diffuser of FIG. 9.
Figure 11:
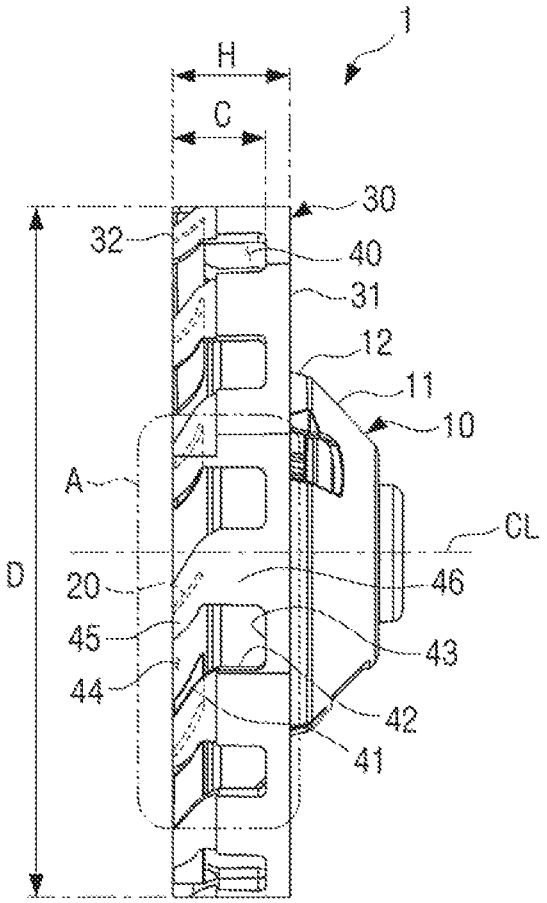
FIG. 11 is a side view of the diffuser of FIG. 9.

Referring to FIGS. 9, 10, and 11, the diffuser 1 may include a central portion 10, a plurality of blades 20, and an outer guide wall 30.

The central portion 10 may be provided at the center of the diffuser 1 so that the motor 121 is disposed at the central portion 10, and may be formed to protrude rearward than the outer guide wall 30. The central portion 10 may include a motor mounting portion 11 on which the motor 121 is disposed, an air guide portion 12 provided outside the motor mounting portion 11, and a blade support portion 13 extending from the air guide portion 12.

The motor mounting portion 11 may be formed in a protruding shape to be inserted into the hub 124 of the fan 123. A through hole 14 through which the shaft 122 of the motor 121 passes may be formed in the center of the motor mounting portion 11. Accordingly, when the motor 121 is disposed in the motor mounting portion 11, the shaft 122 of the motor 121 may protrude to the outside of the motor mounting portion 11 through the through hole 14. The hub 124 of the fan 123 may be fixed to one end of the shaft 122 protruding to the outside of the motor mounting portion 11.

The motor mounting portion 11 may be formed to fix the motor 121 with a motor cover 129.

The air guide portion 12 may be formed to extend from the periphery of the motor mounting portion 11, and may be formed as an inclined surface inclined upward toward the outer guide wall 30 from the through hole 14 of the motor mounting portion 11. The air guide portion 12 may be formed to have an inclination corresponding to the inclined portion 124*b* of the hub 124. Accordingly, the air discharged from the fan 123 may move to the plurality of blades 20 along the air guide portion 12.

The blade support portion 13 may extend from one end of the air guide portion 12 and may be formed substantially parallel to the center line CL of the diffuser 1. Therefore, the blade support portion 13 may be formed in a substantially hollow cylindrical shape. The plurality of blades 20 may be disposed at regular intervals on the outer circumferential surface of the blade support portion 13. In other words, one end of each of the plurality of blades 20 may be fixed to the blade support portion 13.

The plurality of blades 20 may be radially disposed on the outer circumferential surface of the central portion 10. In detail, the plurality of blades 20 may be radially disposed on the outer circumferential surface of the blade support portion 13 of the central portion 10, and may be spaced apart at regular intervals along the outer circumferential surface of the blade support portion 13. Accordingly, the air discharged by the fan 123 may be discharged to the rear of the fan 123 through a plurality of spaces formed between the plurality of blades 20.

The outer guide wall 30 may be disposed concentrically with the central portion 10 and may be disposed to surround the plurality of blades 20. Accordingly, one end of each of the plurality of blades 20 is fixed to the outer circumferential surface of the blade support portion 13 of the central portion 10, and the other end of each of the plurality of blades 20 is fixed to the inner surface of the outer guide wall 30.

The outer guide wall 30 may be formed in a substantially hollow cylindrical shape. However, in the case of this embodiment, as illustrated in FIG. 10, flat portions 30*a* are formed on the four sides of the outer guide wall 30. The four flat portions 30*a* may be formed such that two flat portions 30*a* facing each other are parallel to each other and two adjacent flat portions 30*a* form a right angle to each other. Accordingly, a virtual straight line VL connecting the four flat portions 30*a* may form a rectangle or a square.

In the case where the flat portions 30*a* are formed on the outer guide wall 30 as described above, when the diffuser 1 is disposed in the diffuser hole 113 of the front opening 111 of the main body 110, the rotation of the diffuser 1 may be prevented. In addition, the size of the main body 110 in which the diffuser 1 is disposed may be reduced.

The outer guide wall 30 may be formed to have a height greater than the sum of the height of the blade support portion 13 and the height of the air guide portion 12 of the central portion 10. The front end of the outer guide wall 30 may be formed to be positioned on the same plane as the front end of the blade support portion 13 of the central portion 10. Here, the front end of the blade support portion 13 refers to one end of the blade support portion 13 that is not connected to the air guide portion 12.

Further, the outer guide wall 30 of the diffuser 1 may be formed to have an outer diameter D greater than the maximum diameter Df of the fan 123. Thus, all of the air discharged from the fan 123 may be guided by the diffuser 1.

The outer guide wall 30 may include a plurality of openings 40. The outer guide wall 30 may include the plurality of openings 40 formed in a plurality of portions of the outer guide wall 30 each of which corresponds to a space between two adjacent blades 20 among the plurality of blades 20.

The plurality of openings 40 may be formed in various shapes as long as the portions of the outer guide wall 30 supporting the plurality of blades 20 are not damaged. In other words, the openings 40 are not formed in the portions of the outer guide wall 30 supporting the plurality of blades 20.

The plurality of openings 40 may be formed in the outer guide wall 30 to correspond to the plurality of blades one-to-one. Alternatively, the plurality of openings 40 may be formed so as not to correspond to the plurality of blades 20 one-to-one.

For example, the plurality of openings 40 may be formed in the outer guide wall 30 so as to correspond to the plurality of blades 20 one-to-two or one-to-three. In other words, one opening 40 may be formed for every two or three blades 20.

The plurality of openings 40 may be formed in the same shape. Therefore, hereinafter, it will be described based on a single opening 40.

The opening 40 provided in the outer guide wall 30 may be formed in a groove shape in which one side is open and the other side is closed. In other words, the opening 40 may be formed in a groove shape with a bottom 43.

For example, the opening 40 may be formed so that one side of the opening 40 facing a first end 31 of the outer guide wall 30 corresponding to the upstream based on the direction of air flow passing through the diffuser 1 is closed and the other side of the opening 40 facing a second end 32 of the outer guide wall 30 corresponding to the downstream is open. In other words, the opening 40 may be formed by removing a portion of the outer guide wall 30 from the second end 32 of the outer guide wall 30 toward the first end 31 thereof.

Here, the depth cat which the outer guide wall 30 is removed to form the opening 40, that is, the depth c from the second end 32 of the outer guide wall 30 to the bottom 43 of the opening 40 may be about 25% or more of the height H of the outer guide wall 30.

The opening 40 may include a vertical opening 42 and an inclined opening 41. The vertical opening 42 may be formed substantially perpendicular to the first end 31 of the outer guide wall 30. The vertical opening 42 may be formed to contact the bottom 43 of the opening 40.

The inclined opening 41 may be formed to be inclined at an angle with respect to the vertical opening 42. The inclined opening 41 may be formed adjacent to an entrance 44 of the opening 40 and communicate with the vertical opening 42. The inclined opening 41 may be formed between two adjacent blades 20. The inclined opening 41 may be formed so as not to interfere with the outer guide wall 30 supporting the blades 20.

Accordingly, an inclined support portion 45 and a vertical portion 46 may be provided between the two adjacent openings 40. In other words, the outer guide wall 30 may include the inclined support portion 45 formed adjacent to the inclined opening 41 and the vertical portion 46 formed adjacent to the vertical opening 42.

Therefore, the outer guide wall 30 may include a plurality of inclined openings 41 and a plurality of inclined support portions 45 that are alternately formed. The other end of the blade 20 may be fixed to the inner surface of the inclined support portion 45. In other words, the inclined support portion 45 may support the other end of the blade 20.

A plurality of vertical portions 46 are formed to extend from the plurality of inclined support portions 45. Accordingly, the outer guide wall 30 may include a plurality of vertical openings 42 and the plurality of vertical portions 46 that are formed alternately.

Hereinafter, various modified examples of the diffuser 1 according to an embodiment of the disclosure will be described in detail with reference to FIGS. 12, 13, 14, and 15.

Figure 12:
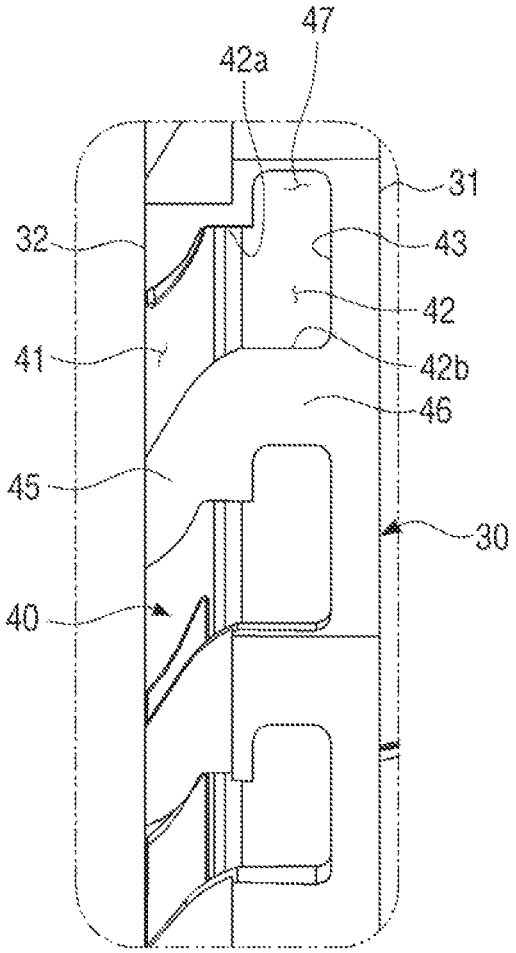
FIG. 12 is a partial view illustrating a modified example of a diffuser according to an embodiment.
Figure 13:
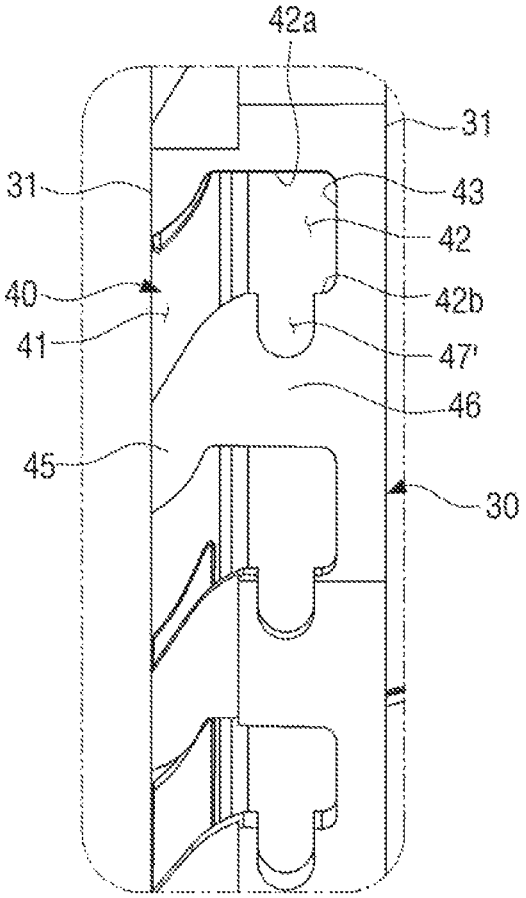
FIG. 13 is a partial view illustrating a modified example of a diffuser according to an embodiment.
Figure 14:
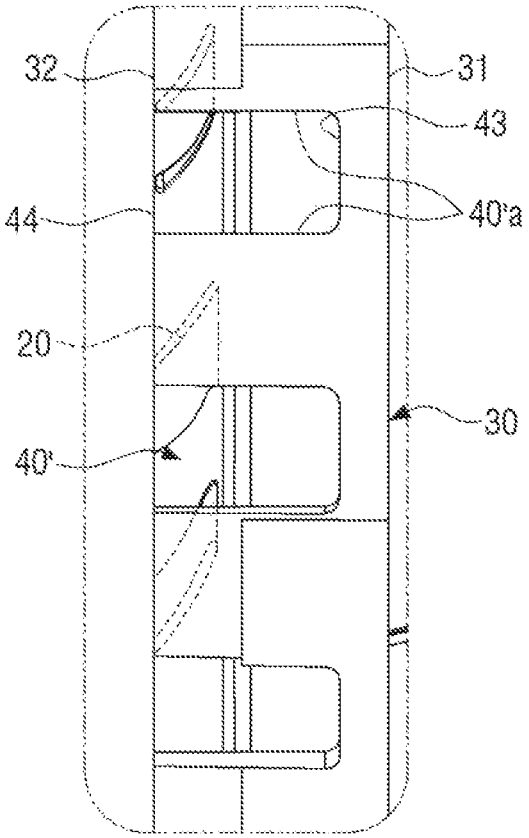
FIG. 14 is a partial view illustrating a modified example of a diffuser according to an embodiment.
Figure 15:
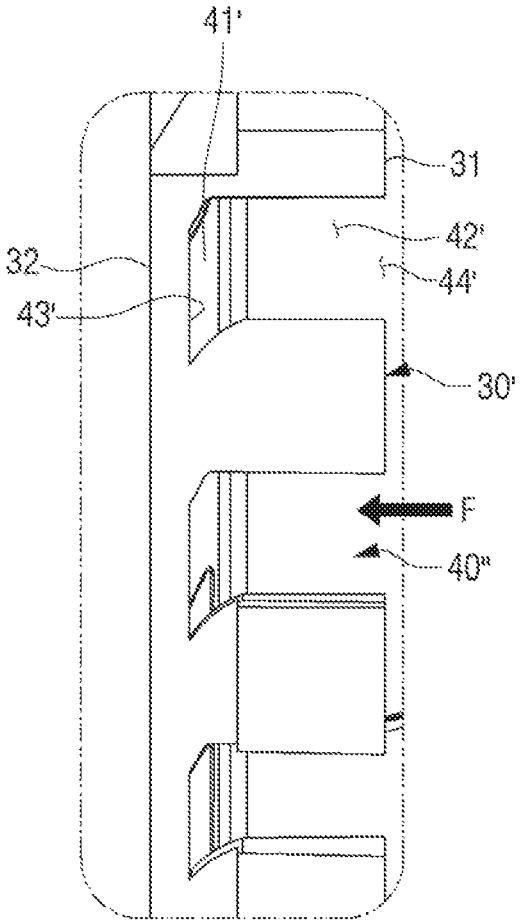
FIG. 15 is a partial view illustrating a modified example of a diffuser according to an embodiment.

FIG. 12 is a partial view illustrating a modified example of a diffuser according to an embodiment. FIG. 13 is a partial view illustrating a modified example of a diffuser according to an embodiment. FIG. 14 is a partial view illustrating a modified example of a diffuser according to an embodiment. FIG. 15 is a partial view illustrating a modified example of a diffuser according to an embodiment. For reference, FIGS. 12, 13, 14, and 15 show portions corresponding to a portion A of FIG. 11.

Referring to FIGS. 12 and 13, the opening 40 may include a vertical opening 42, an inclined opening 41, and a recessed portion 47.

The vertical opening 42 may be formed substantially perpendicular to the first end 31 of the outer guide wall 30. The vertical opening 42 may be formed in contact with the bottom 43 of the opening 40 and may include both sides 42*a* and 42*b* substantially perpendicular to the bottom 43 of the opening 40. The bottom 43 of the opening 40 may be formed substantially parallel to the first end 31 of the outer guide wall 30.

The inclined opening 41 may be formed adjacent to the entrance 44 of the opening 40 and may communicate with the vertical opening 42. The inclined opening 41 may be formed to be inclined at an angle with respect to the vertical opening 42.

The inclined opening 41 may be formed between two adjacent blades 20. An inclined support portion 45 supporting the blade 20 may be provided between the two adjacent inclined openings 41. The inclined opening 41 may be formed so as not to prevent the inclined support portion 45 from supporting the blade 20.

The recessed portion 47 may be formed in the vertical portion 46 between two adjacent vertical openings 42. For example, the recessed portion 47 may be formed by removing the vertical portion 46 in a predetermined shape from one side 42*a* or 42*b* of the vertical opening 42. The recessed portion 47 may be formed so not to damage the strength of the vertical portion 46 of the outer guide wall 30.

The recessed portion 47 may be formed in one of the both sides 42*a* and 42*b* of the vertical opening 42. FIG. 12 illustrates a case where the recessed portion 47 is formed in the upper side 42*a* of the vertical opening 42. FIG. 13 illustrates a case where the recessed portion 47' is formed in the lower side 42*b* of the vertical opening 42.

In addition, in FIG. 12, the recessed portion 47 is formed in a substantially rectangular shape, and in FIG. 13, the recessed portion 47' is formed in a shape having both side walls formed in parallel straight lines and a bottom of a semicircular shape. However, the shape of the recessed portion 47 and 47' is not limited thereto. The recessed portion 47 and 47' may be formed in various shapes as long as the strength of the vertical portion 46 of the outer guide wall 30 is not impaired.

In the above description, the opening 40 includes the inclined opening 41 and the vertical opening 42. However, the shape of the opening 40 is not limited thereto. The opening 40 may be formed in various shapes as long as air discharged from the fan 123 can pass them.

For example, an opening 40' may be formed to include only a vertical opening as illustrated in FIG. 14. In other words, the opening 40' shown in FIG. 14 does not include the inclined opening 41 unlike the opening 40 shown in FIG.

11. Accordingly, in FIG. 14, the opening 40' extends vertically from the bottom 43 and includes two side walls 40'a forming the entrance 44.

In the above description, the entrance 44 of the opening 40 is formed at the second end 32 of the outer guide wall 30 corresponding to the downstream based on the direction of air flow passing through the diffuser 1. However, as illustrated in FIG. 15, an entrance 44' of the opening 40" may be formed in the first end 31 of the outer guide wall 30'.

Referring to FIG. 15, the plurality of openings 40" may be formed so that one side of the opening 40" facing the first end 31 of the outer guide wall 30' corresponding to the upstream based on the direction of air flow (arrow F) passing through the diffuser 1 is open and the other side of the opening 40" facing the second end 32 of the outer guide wall 30 corresponding to the downstream is closed. In other words, the opening 40" may be formed by removing a portion of the outer guide wall 30 from the first end 31 of the outer guide wall 30 toward the second end 32 thereof.

Each of the plurality of openings 40" may include a vertical opening 42' and an inclined opening 41'. The vertical opening 42' may be formed substantially perpendicular to the first end 31 of the outer guide wall 30' and may communicate with an entrance 44' of the opening 40".

The inclined opening 41' may be formed to be inclined at an angle with respect to the vertical opening 42'. In other words, the inclined opening 41' may be formed at an angle with respect to the bottom 43' of the opening 40" and may communicate with the vertical opening 42'.

Figure 16:
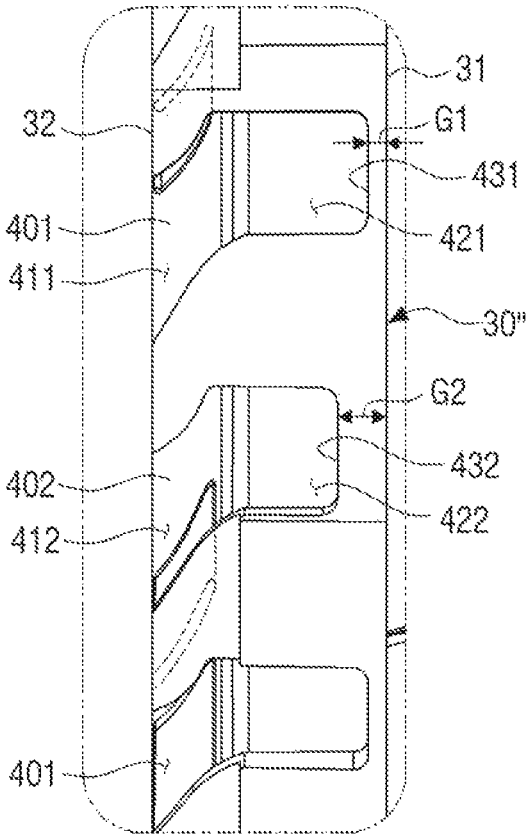
FIG. 16 is a partial view illustrating a modified example of a diffuser according to an embodiment.

In the above description, the plurality of openings 40, 40', and 40" have the same shape and size. However, the plurality of openings 40, 40', and 40" are not limited thereto. The plurality of openings 40, 40', and 40" may be formed to have different shapes and sizes. FIG. 16 shows a diffuser in which the plurality of openings are formed in different shapes.

Referring to FIG. 16, a plurality of openings provided in the outer guide wall 30" may include a plurality of first openings 401 and a plurality of second openings 402. The plurality of first openings 401 are all formed identically. The plurality of second openings 402 are all formed identically. The first opening 401 is formed differently from the second opening 402.

For example, both the first opening 401 and the second opening 402 may include inclined openings 411 and 412 and vertical openings 421 and 422. The first opening 401 and the second opening 402 have a difference in distances G1 and G2 between the bottom 431 and the first end 31 of the outer guide wall 30". In detail, a first distance G1 between the bottom 431 of the first opening 401 and the first end 31 of the outer guide wall 30" is smaller than the second distance G2 between the bottom 432 of the second opening 402 and the first end 31 of the outer guide wall 30". Accordingly, the length of the vertical opening 421 of the first opening 401 is longer than the length of the vertical opening 402 of the second opening 402.

The plurality of first openings 401 and the plurality of second openings 402 may be alternately formed in the circumferential direction of the outer guide wall 30". In other words, as illustrated in FIG. 16, the plurality of first openings 401 and the plurality of second openings 402 may be formed in the outer guide wall 30" in the order of the first opening 401, the second opening 402, and the first opening 401.

In FIG. 16, the plurality of openings 401 and 402 have the same shape but different sizes. However, the plurality of openings are not limited thereto. For example, although not illustrated, the outer guide wall may be formed so that the plurality of openings include at least two of the above-described various types of openings.

Hereinafter, air flow in an air conditioner using a diffuser according to an embodiment of the disclosure will be described in comparison with air flow in an air conditioner using a conventional diffuser without an opening in an outer guide wall with reference to FIGS. 17 and 18.

Figure 17:
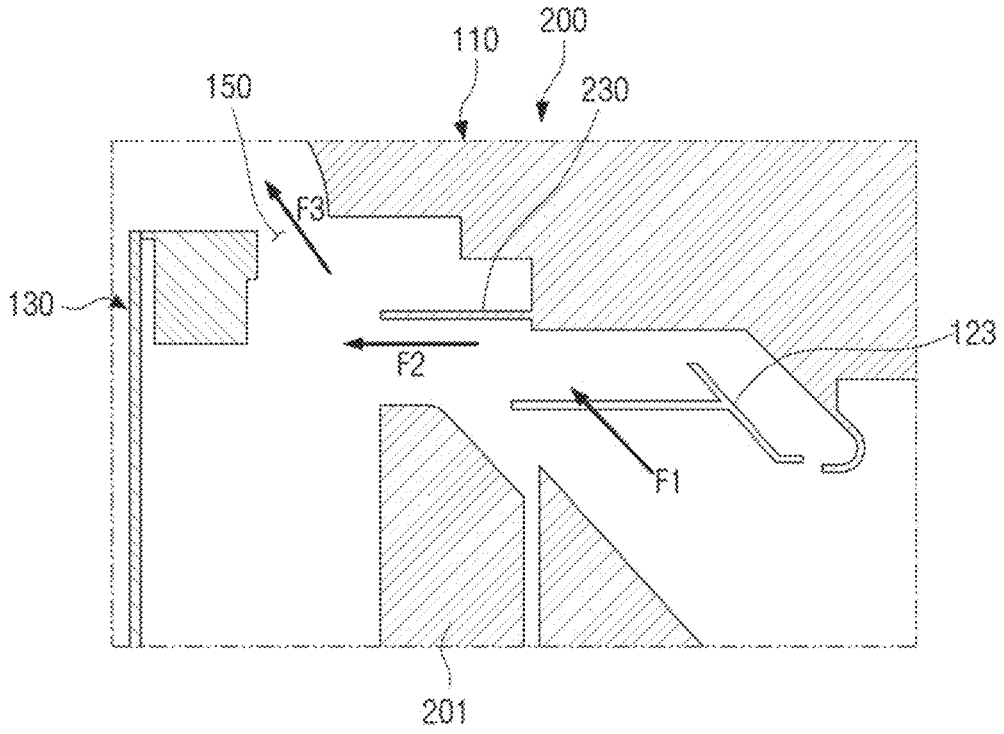
FIG. 17 is a view illustrating air flow in an air conditioner using a conventional diffuser.

FIG. 17 is a view illustrating air flow in an air conditioner using a conventional diffuser. FIG. 18 is a view illustrating air flow in an air conditioner using a diffuser according to an embodiment. FIG. 19 is a perspective view illustrating a conventional diffuser. For reference, the air conditioner 200 of FIG. 17 uses a conventional diffuser 201 illustrated in FIG. 19. In addition, the air conditioner 200 of FIG. 17 is the same as the air conditioner 100 according to an embodiment of the disclosure as illustrated in FIG. 18 except for the diffuser 201.

Referring to FIG. 17, in the air conditioner 200 using the conventional diffuser 201, an air flow (arrow F1) discharged in the diagonal direction from a mixed flow fan 123 moves along an outer guide wall 230 of the diffuser 201 as show in arrow F2, and then is discharged to the outside through an air outlet 150 between a front panel 130 and the front surface of the main body 110 (arrow F3).

In other words, in the air conditioner 200 according to the prior art, the outer guide wall 230 of the diffuser 201 acts as a resistance against the air flow F1 being discharged in the diagonal direction from the mixed flow fan 123.

Figure 18:
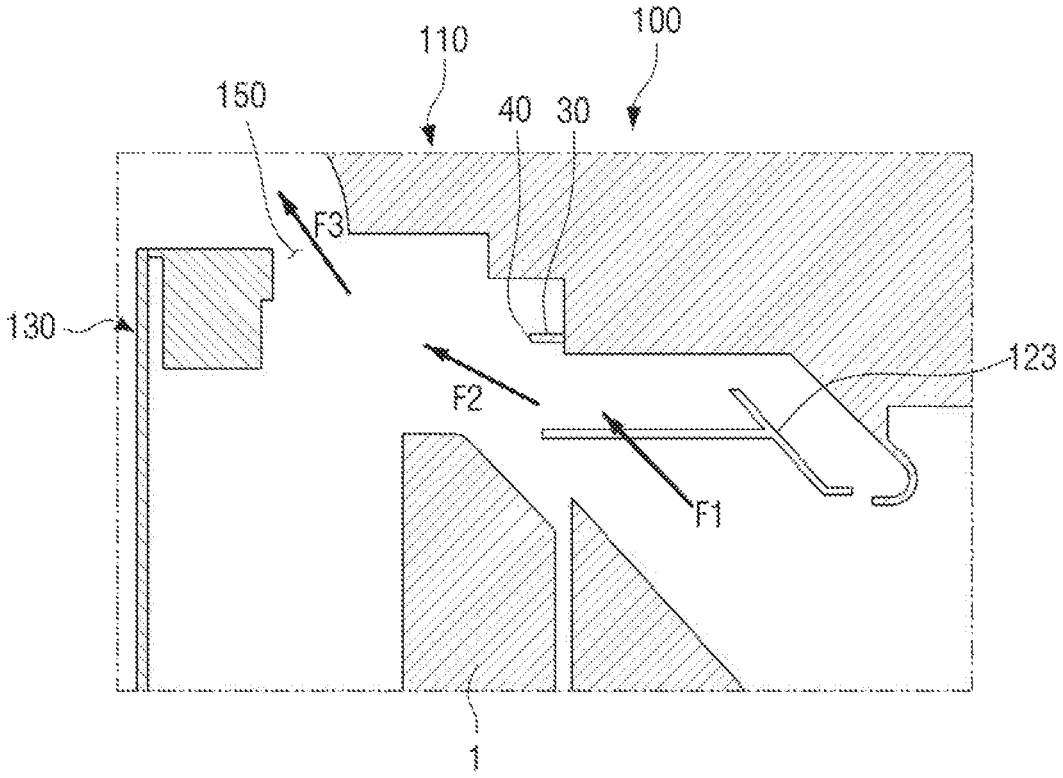
FIG. 18 is a view illustrating air flow in an air conditioner using a diffuser according to an embodiment.
Figure 19:
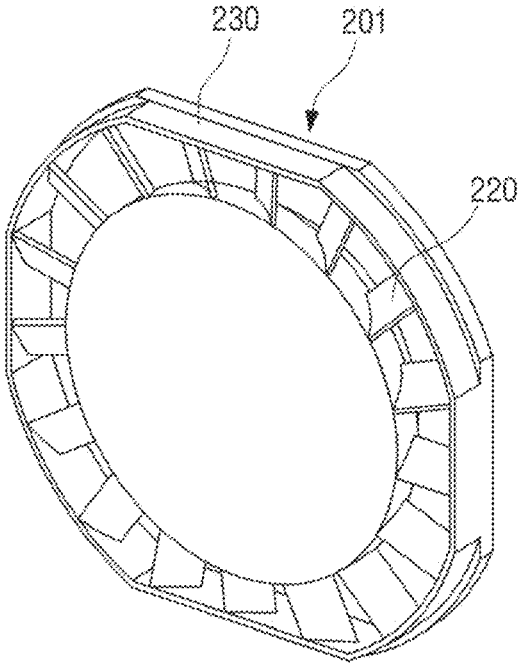
FIG. 19 is a perspective view illustrating a conventional diffuser.

Referring to FIG. 18, in the air conditioner 100 using a diffuser 1 according to an embodiment of the disclosure, an air flow (arrow F1) discharged in the diagonal direction from the mixed flow fan 123 moves in the diagonal direction through the opening 40 formed in the outer guide wall 30 of the diffuser 1 (arrow F2), and then is discharged to the outside through the air outlet 150 between the front panel 130 and the front surface of the main body 110 (arrow F3).

In other words, in the diffuser 1 according to an embodiment of the disclosure, because the outer guide wall 30 includes a plurality of openings 40, the outer guide wall 30 does not act as a resistance against the air flow being discharged from the mixed flow fan 123 unlike the conventional diffuser 201.

Accordingly, the air conditioner 100 using the diffuser 1 according to an embodiment of the disclosure may have improved flow performance compared to the air conditioner 200 using the conventional diffuser 201.

The inventors performed a computer simulation to compare the flow performance of the air conditioner 100 using the diffuser 1 according to an embodiment of the disclosure and the flow performance of the air conditioner 200 using the conventional diffuser 201. The result of the computer simulation will be described with reference to FIG. 20.

Figure 20:
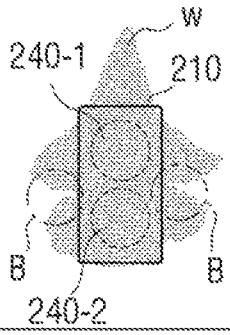
FIG. 20 is a table showing the results of computer simulations of air flow of an air conditioner using a diffuser according to an embodiment and air flow of an air conditioner using a conventional diffuser.
Figure 20:
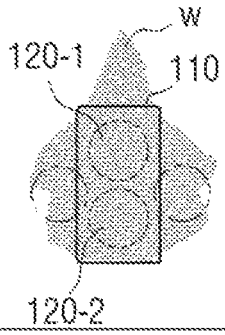
Figure 20:
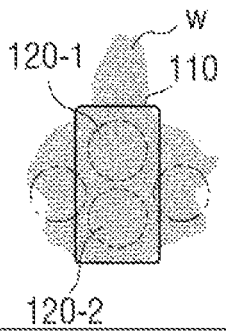

FIG. 20 is a table showing the result of computer simulation of air flow of an air conditioner using a diffuser according to an embodiment and air flow of an air conditioner using a conventional diffuser.

The computer simulation was performed using an air conditioner equipped with two diffuser assemblies. The two diffuser assemblies 240-1 and 240-2 and 120-1 and 120-2 are arranged in a straight line in the vertical direction.

A front panel 130, that is, a windless panel is disposed in front of the two diffuser assemblies 240-1 and 240-2 and 120-1 and 120-2. Accordingly, air discharged from the two diffuser assemblies 240-1 and 240-2 and 120-1 and 120-2 may be discharged through the three sides of the main body 110, that is, through the top side, the left side, and the right side of the main body 110. In addition, air discharged from the two diffuser assemblies 240-1 and 240-2 and 120-1 and 120-2 may be discharged through the windless panel 130.

The two diffuser assemblies 240-1 and 240-2 and 120-1 and 120-2 are configured so that the fans of the diffuser assemblies 240-1 and 120-1 disposed at the upper side rotate at a higher speed than the fans of the diffuser assemblies 240-2 and 120-2 disposed at the lower side. In this computer simulation, the fans of the upper diffuser assemblies 240-1 and 120-1 are set to rotate at 1250 RPM and the fans of the lower diffuser assemblies 240-2 and 120-2 are set to rotate at 1170 RPM.

Embodiment 1 is a case where the plurality of openings 40 of the outer guide wall 30 of the diffuser 1 used in the air conditioner are formed in the shape as illustrated in FIG. 11. Embodiment 2 is a case where the width of each of the plurality of openings formed in the outer guide wall of the diffuser is formed to be wider than the width of each of the openings shown in FIG. 11.

Referring to FIG. 20, in the air conditioner using a diffuser according to an embodiment of the disclosure, the air volume discharged through the top, left, and right sides of the main body 110 is larger than the air volume discharged through the top, left, and right sides of the main body 210 of the air conditioner using the conventional diffuser. However, the air volume discharged through the windless panel is slightly reduced compared to the air conditioner according to the prior art.

Accordingly, it can be seen that the air volume of the air conditioner using the diffuser according to an embodiment of the disclosure increases by 4.4% or more compared to the air conditioner using the conventional diffuser. Here, the unit of the air volume is CMM ($m^3$/min).

Referring to FIG. 20, in the air conditioner using the conventional diffuser, the three-sided flow rate deviation is 1.17 m/s. However, in Embodiment 1 of the disclosure, the three-sided flow rate deviation is 0.95 m/s, and in Embodiment 2, the three-sided flow rate deviation is 0.99 m/s. Here, the three-sided flow rate deviation represents the maximum deviation of the air flow rate discharged from the three sides of the main body. Therefore, when the three-sided flow rate deviation is small, it means that air is uniformly discharged from the three sides of the main body.

The three-sided flow rate deviation of the air conditioner using the diffuser according to an embodiment of the disclosure is smaller than the three-sided flow rate deviation of the air conditioner using the conventional diffuser. Accordingly, the air conditioner using the diffuser according to an embodiment of the disclosure may discharge air more evenly through three sides of the main body than the air conditioner using the conventional diffuser.

In addition, looking at the flow rate distribution in the discharge port in FIG. 20 (the part indicated by W in FIG. 20), in the air conditioner using the conventional diffuser, there is a section (circle B) in which air flow is cut off between the two diffuser assemblies 240-1 and 240-2.

However, in the air conditioner using the diffuser according to an embodiment of the disclosure, there is no section in which air flow is cut off between the two diffuser assemblies 120-1 and 120-2. Accordingly, in the air conditioner using the diffuser according to an embodiment of the disclosure, the flow rate deviation of the air flows discharged through the left and right discharge ports of the main body may be reduced.

In the above description, an air purifier has been described as an example as an air conditioner using a diffuser according to an embodiment of the disclosure. However, the air conditioner is not limited thereto. A diffuser and a diffuser assembly according to an embodiment of the disclosure may be used in various electronic devices configured to intake and discharge air using a fan, such as a humidifier, a clothes manager, and the like having an air cleaning function.

Hereinabove, the disclosure has been described as an illustrative method. It is to be understood that terms used herein are provided to describe the disclosure rather than limiting the disclosure. Various modifications and alternations of the disclosure may be made according to the contents described above. Therefore, the disclosure may be freely practiced without departing from the scope of the claims unless additionally mentioned.

What is claimed is:

1. A diffuser configured to be used in an air conditioner, the diffuser comprising:

a central portion configured to receive a motor having a shaft;

a plurality of blades extending radially at intervals from an outer circumferential surface of the central portion; and an outer guide wall concentric with the central portion and surrounding the plurality of blades, the outer guide wall including a plurality of openings with at least one opening of the plurality of openings between one pair of adjacent blades of the plurality of blades, wherein the central portion is formed to protrude more rearward than the outer guide wall, and the central portion comprises:

a motor mounting portion on which the motor is disposed and including a through hole through which the shaft of the motor passes;

an air guide portion provided outside the motor mounting portion and formed as an inclined surface inclined upward toward the outer guide wall; and a blade support portion extending from the air guide portion.

2. The diffuser as claimed in claim 1, wherein a portion of each of the plurality of openings in the outer guide wall facing a first end of the outer guide wall corresponding to an upstream direction based on a direction of air flow passing through the diffuser, is defined by a bottom in the outer guide wall, and another portion of each of the plurality of openings facing a second end of the outer guide wall corresponding to a downstream direction based on the direction of air flow passing through the diffuser, is open.

3. The diffuser as claimed in claim 2, wherein a depth from the second end of the outer guide wall to a bottom of each of the plurality of openings is 25% or more of a height of the outer guide wall.

4. The diffuser as claimed in claim 1, wherein each of the plurality of openings comprises:

a vertical portion perpendicular to a first end of the outer guide wall; and an inclined portion inclined with respect to the vertical portion.

5. The diffuser as claimed in claim 4, wherein each of the plurality of openings further comprises a recessed portion in one side of the vertical portion.

6. The diffuser as claimed in claim 4, wherein the outer guide wall includes an inclined support portion adjacent to the inclined portion, and one end of one of the plurality of blades extends from an inner surface of the inclined support portion.

7. The diffuser as claimed in claim 1, wherein the plurality of openings in the outer guide wall correspond to the plurality of blades one-to-one.

8. The diffuser as claimed in claim 1, wherein the plurality of openings have a same shape and an equal area.

9. The diffuser as claimed in claim 1, wherein a portion of each of the plurality of openings in the outer guide wall facing a first end of the outer guide wall corresponding to an upstream direction based on a direction of air flow passing through the diffuser, is open, and another portion of each of the plurality of openings facing a second end of the outer guide wall corresponding to a downstream direction based on the direction of air flow passing through the diffuser, is defined by a bottom in the outer guide wall.

10. The diffuser as claimed in claim 1, wherein each opening of the plurality of openings corresponds to one or more blades of the plurality of blades so that a number of openings of the plurality of openings correspond to a number of blades of the plurality of blades one-to-one or one-to-more than one.

11. A diffuser assembly configured to be used in an air conditioner, the diffuser assembly comprising:

a motor having a shaft;

a fan coupled to the shaft of the motor and configured to discharge air; and a diffuser coupled to the motor and configured to guide the air discharged by the fan, the diffuser comprising:

a central portion coupled to the motor;

a plurality of blades extending radially at intervals from an outer circumferential surface of the central portion; and an outer guide wall concentric with the central portion and surrounding the plurality of blades, the outer guide wall including a plurality of openings with at least one opening of the plurality of openings between one pair of adjacent blades of the plurality of blades, wherein the central portion is formed to protrude more rearward than the outer guide wall, and the central portion comprises:

a motor mounting portion on which the motor is disposed and including a through hole through which the shaft of the motor passes;

an air guide portion provided outside the motor mounting portion and formed as an inclined surface inclined upward toward the outer guide wall; and a blade support portion extending from the air guide portion.

12. The diffuser assembly as claimed in claim 11, wherein an outer diameter of the outer guide wall of the diffuser is greater than a maximum diameter of the fan.

13. The diffuser assembly as claimed in claim 11, wherein a portion of each of the plurality of openings in the outer guide wall facing a first end of the outer guide wall corresponding to an upstream direction-based on a direction of air flow passing through the diffuser, is defined by a bottom in the outer guide wall, and another portion of each of the plurality of openings facing a second end of the outer guide wall corresponding to a downstream direction based on the direction of air flow passing through the diffuser, is open.

14. The diffuser assembly as claimed in claim 11, wherein each of the plurality of openings comprises:

a vertical portion perpendicular to a first end of the outer guide wall; and an inclined portion inclined with respect to the vertical portion.

15. The diffuser assembly as claimed in claim 14, wherein each of the plurality of openings further comprises a recessed portion in one side of the vertical portion.

16. The diffuser assembly as claimed in claim 15, wherein the outer guide wall includes an inclined support portion adjacent to the inclined portion, and one end of one of the plurality of blades extends from an inner surface of the inclined support portion.

17. The diffuser assembly as claimed in claim 11, wherein the plurality of openings in the outer guide wall correspond to the plurality of blades one-to-one.

18. The diffuser assembly as claimed in claim 11, wherein the plurality of openings have a same shape and an equal area.

19. The diffuser assembly as claimed in claim 11, wherein a portion of each of the plurality of openings in the outer guide wall facing a first end of the outer guide wall corresponding to an upstream direction based on a direction of air flow passing through the diffuser, is open, and another portion of each of the plurality of openings facing a second end of the outer guide wall corresponding to a downstream direction based on the direction of air flow passing through the diffuser, is defined by a bottom in the outer guide wall.

20. An air conditioner comprising:

a main body having a front opening in a front surface thereof;

a diffuser in the front opening of the main body;

a motor coupled to the diffuser and having a shaft;

a fan in the front opening and configured to be rotated by the motor;

a front panel spaced apart from the front surface of the main body to cover the diffuser; and an air outlet between an edge of the front panel and an edge of the front opening of the main body, the diffuser comprising:

a central portion coupled to the motor;

a plurality of blades extending radially at intervals from an outer circumferential surface of the central portion; and an outer guide wall concentric with the central portion and surrounding the plurality of blades, the outer guide wall including a plurality of openings with at least one opening of the plurality of opening between one pair of adjacent blades of the plurality of blades, so that the diffuser is configured to guide air generated when the fan is rotated, through the plurality of openings in the outer guide wall to the air outlet between the edge of the front panel and the edge of the front opening of the main body, wherein the central portion is formed to protrude more rearward than the outer guide wall, and the central portion comprises:

a motor mounting portion on which the motor is disposed and including a through hole through which the shaft of the passes;

an air guide portion provided outside the motor mounting portion and formed as an inclined surface inclined upward toward the outer guide wall; and a blade support portion extending from the air guide portion.

21. The air conditioner as claimed in claim 20, wherein the front panel is movable by a predetermined distance in a vertical direction with respect to the front surface of the main body, and when the front panel is in a position away from the diffuser, the air outlet is open, and when the front panel is in a position closest to the diffuser, the air outlet is closed.

* * * * *